US007533545B2

(12) United States Patent
Mele et al.

(10) Patent No.: US 7,533,545 B2
(45) Date of Patent: May 19, 2009

(54) KNITTING MACHINE

(75) Inventors: Giuseppe Mele, Buchs (CH); Karl-Heinz Papprott, Murg-Niederhof (DE); Francisco Speich, Gipf-Oberfrick (CH)

(73) Assignee: Textilma AG (CH)

( * ) Notice: Subject to any disclaimer, the term of this patent is extended or adjusted under 35 U.S.C. 154(b) by 428 days.

(21) Appl. No.: 10/560,673

(22) PCT Filed: Jun. 3, 2004

(86) PCT No.: PCT/CH2004/000336

§ 371 (c)(1),
(2), (4) Date: Dec. 14, 2005

(87) PCT Pub. No.: WO2004/111322

PCT Pub. Date: Dec. 23, 2004

(65) Prior Publication Data

US 2007/0033969 A1 Feb. 15, 2007

(30) Foreign Application Priority Data

Jun. 19, 2003 (CH) ..... 1075/03

(51) Int. Cl.
*D04B 23/12* (2006.01)

(52) U.S. Cl. ..... 66/84 A; 66/125 R

(58) Field of Classification Search ..... 66/84 A, 66/84 R, 125 R

See application file for complete search history.

(56) References Cited

U.S. PATENT DOCUMENTS

| | | | | | |
|---|---|---|---|---|---|
| 4,487,039 | A | | 12/1984 | Mayer | |
| 4,528,631 | A | * | 7/1985 | Bogucki-Land | 700/130 |
| 4,703,631 | A | * | 11/1987 | Naumann et al. | 66/84 A |
| 4,761,973 | A | * | 8/1988 | Gangi | 66/204 |
| 5,111,672 | A | * | 5/1992 | Gille et al. | 66/84 A |
| 5,375,435 | A | | 12/1994 | Gille et al. | |
| 6,010,052 | A | | 1/2000 | Leins et al. | |

FOREIGN PATENT DOCUMENTS

| | | |
|---|---|---|
| DE | 2 244 114 | 9/1972 |
| EP | 1 231 310 A1 | 1/2002 |

* cited by examiner

*Primary Examiner*—Danny Worrell
(74) *Attorney, Agent, or Firm*—George Pappas

(57) ABSTRACT

Disclosed is a knitting machine comprising knitting needles, at least one weft bar (8) for laying at least one weft thread (10) across the knitting needles, an electrically driven thread feeder (14, 22) for the weft thread, a take-down device (28) for the textile material (26), and an electronic device (36) for controlling the knitting machine based on a pattern program for the textile material (26) that is to be produced. In order to improve the production process and the textile material, said control device (36) is provided with control means for adjusting the feeding length of the weft thread (10, 24) that is to be delivered according to the traveling distance of the weft bar (8), which is predefined by the pattern program.

2 Claims, 2 Drawing Sheets

KNITTING MACHINE

This application claims priority of PCT application PCT/CH2004/000336 having a priority date of Jun. 19, 2003, the disclosure of which is hereby incorporated herein by reference.

FIELD OF THE INVENTION

The invention relates to a knitting machine.

BACKGROUND OF THE INVENTION

There are many known knitting machines of the type initially mentioned. Such knitting machines are equipped with an electronic control device for controlling the knitting machine on the basis of a pattern program for the textile material to be produced. The pattern program may be produced in the control device itself or in an external electronic pattern apparatus from which it can then be supplied to the electronic control device in the knitting machine by means of a data carrier or data line. The knitting machine contains, furthermore, electrically driven thread feeders for supplying weft threads to the weft bars which, according to the pattern program, lay the weft threads across the knitting needles which tie up the weft threads. The knitting machines are equipped, furthermore, with a take-down device for the textile material produced. The disadvantage, however, is that the thread feeders can operate only at an adjustable constant speed which is not sufficient in many instances, since, particularly in the case of changing patterning, changing delivery quantities for the weft thread or weft threads are also required, and the weft bars have themselves to draw additional thread lengths which are lacking. This leads to faults in the textile material and/or also in the knitting machine during the processing of thread qualities which, in particular, have different thicknesses.

U.S. Pat. No. 4,487,039 discloses a warp knitting machine in which weft threads are supplied to two transport devices arranged at a distance from one another. For this purpose, there is a carriage which is movable to and fro between the transport devices and to which the weft threads are supplied by means of a driven delivery mechanism. The drive of the delivery mechanism to be changed continuously, taking into account the instantaneous carriage speed and carriage position, in order to adapt the tension of the weft threads to the changing speeds and positions of the carriage and to keep said tension as constant as possible. The drive is controlled via a pulse generator which is dependant on the rotation of the main shaft. An individual control of the length of the weft thread to be supplied in each case, on the one hand, and of the required length on the basis of the pattern program, on the other hand, cannot be gathered from this publication.

SUMMARY OF THE INVENTION

The purpose of the invention is to improve further a knitting machine of the type initially mentioned.

A control device having control means in order to set the delivery length of the weft thread to be supplied according to the travel of the weft bar, said travel being predetermined from the pattern program, ensures that the exactly required thread length is always available for each laying of a weft thread and for each pattern. There is no longer any need for the weft thread to be drawn off by the weft bar, for example from a cone. As a result, the textile material, in general, and the pattern formation, in particular, are appreciably improved.

During the knitting operation, faults, such as thread breaks and flaws, are largely prevented.

A knitting machine having a control device with a manually actuable correcting apparatus for the individual superposition of an adjustable correcting factor onto the delivery data of at least one weft thread for at least one weft insertion is particularly advantageous, since, by means of the correcting factor which additionally varies the delivery length of the weft thread, further adaption, for example, to different thread qualities and/or pattern properties of the textile material to be produced can be achieved.

A particularly advantageous correcting apparatus has, a screen, preferably a touch screen, and an editing element for manual selection of various indicators and control layers, in particular that for handling the correcting factor.

BRIEF DESCRIPTION OF THE DRAWINGS

Exemplary embodiments of the invention are described in more detail below with reference to the drawings in which.

DETAILED DESCRIPTION OF THE INVENTION

Figure 1:
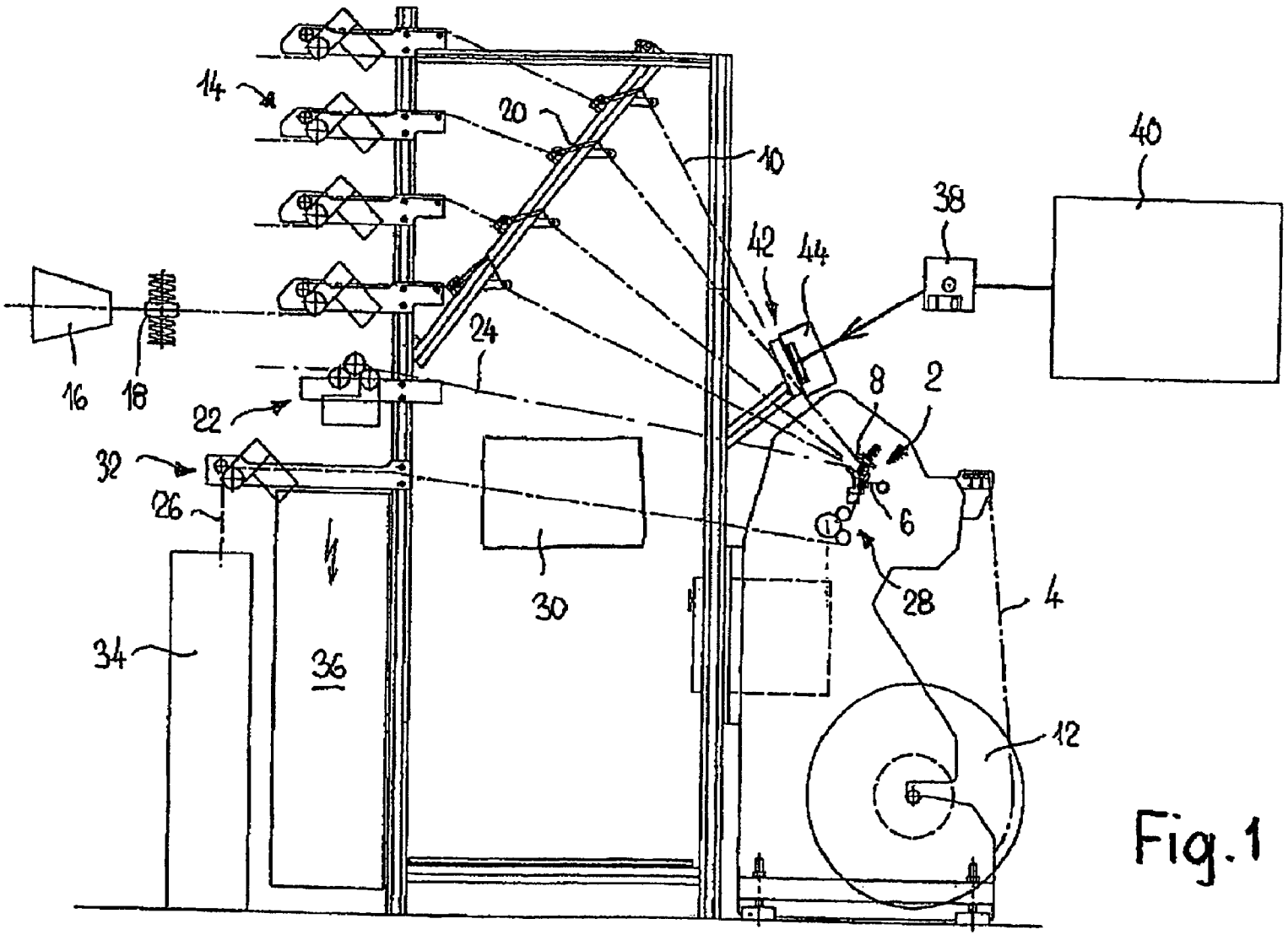
FIG. 1 shows diagrammatically a side view of the set-up of a knitting machine.

FIG. 1 shows a diagram of a knitting machine in a side view. At a knitting station 2, warped threads 4 are introduced in the usual way into knitting needles, not illustrated in any more detail, by means of thread laying devices 6. In addition, by means of thread guides arranged on weft bars 8, weft threads 10 are laid across one or more knitting needles according to the pattern program and are knitted in by means of these. The warped threads 4 are taken down from a warp reel 12. The weft threads 10 are taken down, in each case by means of an electrically driven thread feeder 14, from a reel 16 and via a thread brake 18 and are supplied to the thread guides. Thread tensioners 20 ensure a uniform tension of the thread to be supplied. In the example shown, four weft threads are supplied to the knitting station 2. A further thread feeder 22 serves for supplying a rubber thread 24 to the knitting station 2.

The textile material produced at the knitting station 2 is taken down, for example, from a take-down device 28 provided with an electric drive, runs through a thermosetting device 30 and arrives at an electrically driven additional take-down device 32 which discharges the finished textile material, for example, to a container 34.

The knitting machine contains an electronic control device 36 which, in the example shown, receives the pattern program for the textile material to be produced from an electronic pattern apparatus 40 via a floppy disk 38. The pattern program of the floppy disk 38 is entered into a reader 42 which is connected to the electronic control device 36. The control device 36 contains control means in order to set the delivery length of at least one weft thread 10 to be supplied according to the travel of the weft bar, said travel being predetermined from the pattern program. Furthermore, the control device 36 has a manually actuable correcting apparatus 44 for the individual superposition of an adjusting correcting factor K onto the delivery data of at least one weft thread for at least one weft insertion. The correcting apparatus 44 is described in more detail with reference to FIG. 2.

The correcting apparatus 44 contains a screen 45 which is preferably designed as a touch screen and which has a series of indicator and switching elements for manually selectable indicator and switching layers.

Figure 2:
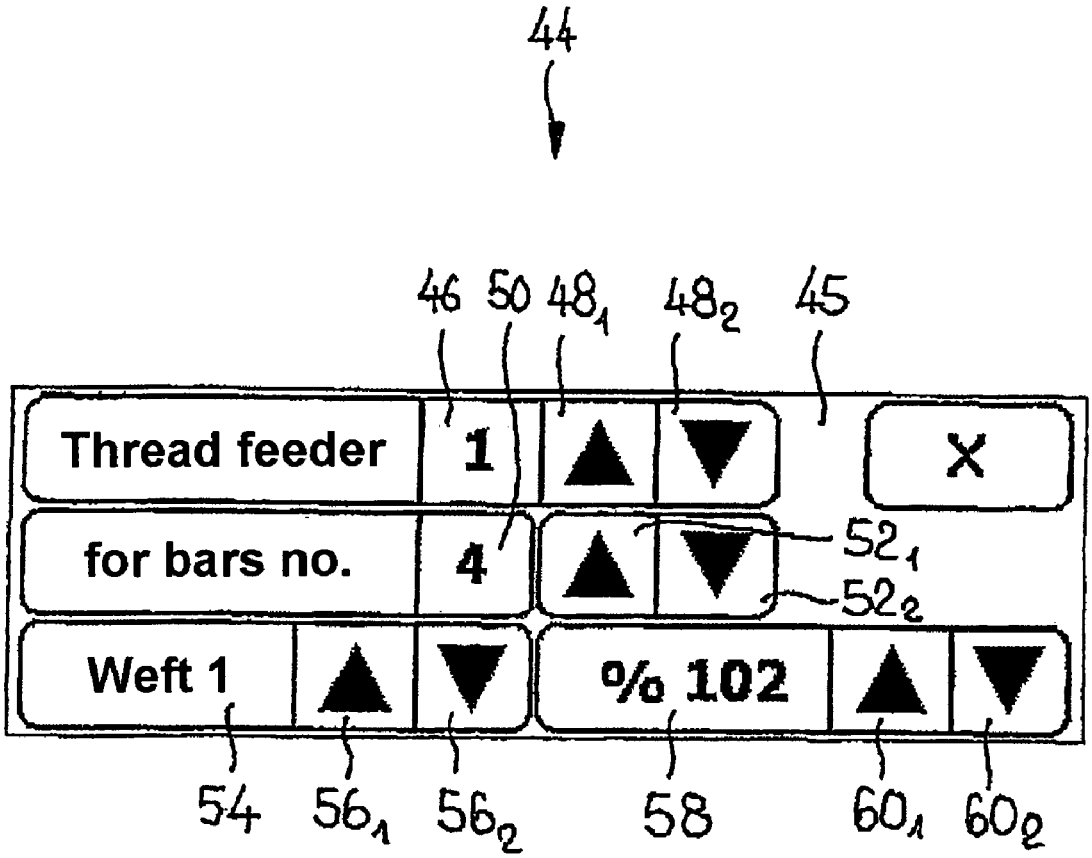
FIG. 2 shows an indicator and switching layer for setting a correcting factor for thread feeders.

FIG. 2 shows the indicator and switching layer for the correcting factor K. The indicator and switching layer contains, first, an indicator element 46 showing the selected thread feeder which can be selected by means of the setting elements $\mathbf{48}_1$, $\mathbf{48}_2$. In the present example, the thread feeder 1 is selected. The indicator element 50 indicates the weft bar, here the weft bar 4, to which the set thread feeder applies, and in this case a corresponding selection can be made by means of the setting elements $\mathbf{52}_1$, $\mathbf{52}_2$. However, it is necessary to coordinate which thread feeder has actually been assigned to which weft bar. The indicator element 54 designates the weft selected by means of the setting elements $\mathbf{56}_1$, $\mathbf{56}_2$, here weft number 1, to which the correcting factor K, which is evident on the indicator element 58 and here amounts to 102%, is to apply. The correcting factor K=102% states that the already individual normal delivery length which is predetermined by control means on the basis of the pattern program and which amounts to 100% is to be increased by 2%. The correcting factor K may be increased or reduced by means of the setting elements $\mathbf{60}_1$, $\mathbf{60}_2$. The indicator and setting layer can be changed by means of the key X.

LIST OF REFERENCE SYMBOLS

K Correcting factor
X Key
2 Knitting station
4 Warp thread
6 Thread laying device
8 Weft bar
10 Weft thread
12 Warp reel
14 Thread feed
16 Reel
18 Thread brake
20 Thread tensioner
22 Thread feeder
24 Rubber thread
26 Textile material
28 Take-down device
30 Thermosetting device
32 Additional take-down device
34 Container
36 Control device
38 Floppy disk
40 Pattern apparatus
42 Reader
44 Correcting apparatus
45 Screen
46 Indicator element—thread feeder
$\mathbf{48}_1$ Setting element
$\mathbf{48}_2$ Setting element
50 Indicator element—weft bar
$\mathbf{52}_1$ Setting element
$\mathbf{52}_2$ Setting element
54 Indicator—weft insertion
$\mathbf{56}_1$ Setting element
$\mathbf{56}_2$ Setting element
58 Indicator element—correcting factor
$\mathbf{60}_1$ Setting element
$\mathbf{60}_2$ Setting element

The invention claimed is:

1. A knitting machine, said knitting machine comprising: knitting needles and at least one weft bar for laying at least one weft thread across at least one knitting needle, with an electrically driven thread feeder for the weft thread, and also with a take-down device for textile material and with an electronic control device for controlling the knitting machine pursuant to a pattern program for the textile material to be produced, wherein the control device has control means in order to set the delivery length of the weft thread to be supplied according to the travel of the weft bar, said travel being predetermined from the pattern program, wherein said knitting machine comprises electrically driven thread feeder means to pull-off the weft thread from a reel, wherein said control device has a manually actuable correcting apparatus for an individual superposition of an adjustable correcting factor onto the delivery data of at least one weft thread for at least one weft insertion, and wherein said correcting apparatus has a screen, and an indicator and control layer for the manual setting of the correcting factor.

2. The knitting machine as claimed in claim 1 wherein said screen is a touch screen.

* * * * *